United States Patent [19]

Holtkamp

[11] 3,932,830

[45] Jan. 13, 1976

[54] PUSH-TO-TURN THERMAL CYCLING SWITCH

[75] Inventor: Calvin J. Holtkamp, Mansfield, Ohio

[73] Assignee: White-Westinghouse Corporation, Cleveland, Ohio

[22] Filed: Jan. 23, 1975

[21] Appl. No.: 543,375

[52] U.S. Cl. ..... 337/64; 337/94; 337/360

[51] Int. Cl.[2] ..... H01H 71/16

[58] Field of Search ..... 200/324–328; 337/64, 82, 95, 96, 99, 335, 338, 339, 340, 337/375, 378, 360, 94

[56] References Cited

UNITED STATES PATENTS

| | | | |
|---|---|---|---|
| 2,592,660 | 4/1952 | Crumley | 200/32 X |
| 3,634,802 | 1/1972 | Aldous | 337/101 |
| 3,737,606 | 6/1973 | Becker | 300/328 |

*Primary Examiner*—J. D. Miller
*Assistant Examiner*—Fred E. Bell
*Attorney, Agent, or Firm*—McNenny, Farrington, Pearne & Gordon

[57] ABSTRACT

A thermal cycling switch such as is used to control surface units on domestic cooking ranges is provided with a compression spring arrangement urging the cam controlling the switch in one direction and a shaft axially movable relative to the cam in an opposite direction, and detent means are provided to prevent the shaft and cam from being rotated until the shaft is first shifted axially relative to the cam.

6 Claims, 3 Drawing Figures

PUSH-TO-TURN THERMAL CYCLING SWITCH

BACKGROUND OF THE INVENTION

1. Field of the Invention

The invention pertains to art of thermal cycling switches.

2. Description of the Prior Art

While the idea of providing a switch arrangement in which a switch knob must first be pushed before it can be rotated is considered to be known, special problems can arise in connection with incorporating a push-to-turn arrangement in a thermal cycling switch intended to control periods of time during which current flows through a cooking surface unit. This is so because of the movements effected by the bimetal assembly in such a switch are relatively small and the problem of getting accurate control at relatively low wattage input, such as at 5 percent, is especially difficult when some of the cooperating parts are of molded plastic. For example, the moding tolerances of these parts may be in the order of 0.002–0.003 inches (0.0508–0.0762mm) while a variation in movement of the adjustable spring arm relative to the bimetal assembly of 0.002–0.004 inches (0.0508–0.1016mm) may result in a variation of the desired 5 percent input of 2 to 12 percent. While the initial calibration of the switch can compensate for most of this variation in range, it is important that the parts when once calibrated will give the desired repeatability of a particular input thereafter. The problem of repeatability is basically only experienced at a low input, because at a higher inputs the setting of the switch itself by the user can compensate to obtain the desired input.

The desirability of having a push-to-turn arrangement for a thermal cycling switch used on cooking ranges is of course for purposes of safety. One aspect of the invention is the provision of an arrangement which is adapted to be incorporated in the standard thermal cycling switch of my assignee, as disclosed in U.S. Pat. No. 3,634,802, without a significant cost being incurred in tool changes and new piece costs.

SUMMARY OF THE INVENTION

In accordance with my invention, there is provided in such a thermal cycling switch an arrangement including a rotatable shaft received in a hollow cam in axially shiftable relation, with means at the upper end of the bore of the cam fixing the shaft and cam for rotation together, compression spring means in the bore of the cam urging the shaft toward an upper position and the cam downwardly to seat its lower end on a tapered collar on the base of the switch casing, and detent means locking the shaft against rotation when the shaft is in the upper position and permitting the rotation upon shifting the shaft axially downwardly a predetermined amount.

In the preferred arrangement, the means fixing the cam and shaft for rotation together comprises a member having a square outline fixed to the shaft and received within a complementary square recess in the cam bore so that the shaft and cam can be indexed at four equiangularly displaced positions.

In the currently preferred form, the detent means comprises a washer fixed to the shaft immediately below the cover of the casing, and provided with a notch which registers with a tab bent down out of the cover.

DRAWING DESCRIPTION

DESCRIPTION OF THE PREFERRED EMBODIMENT

Figure 1:
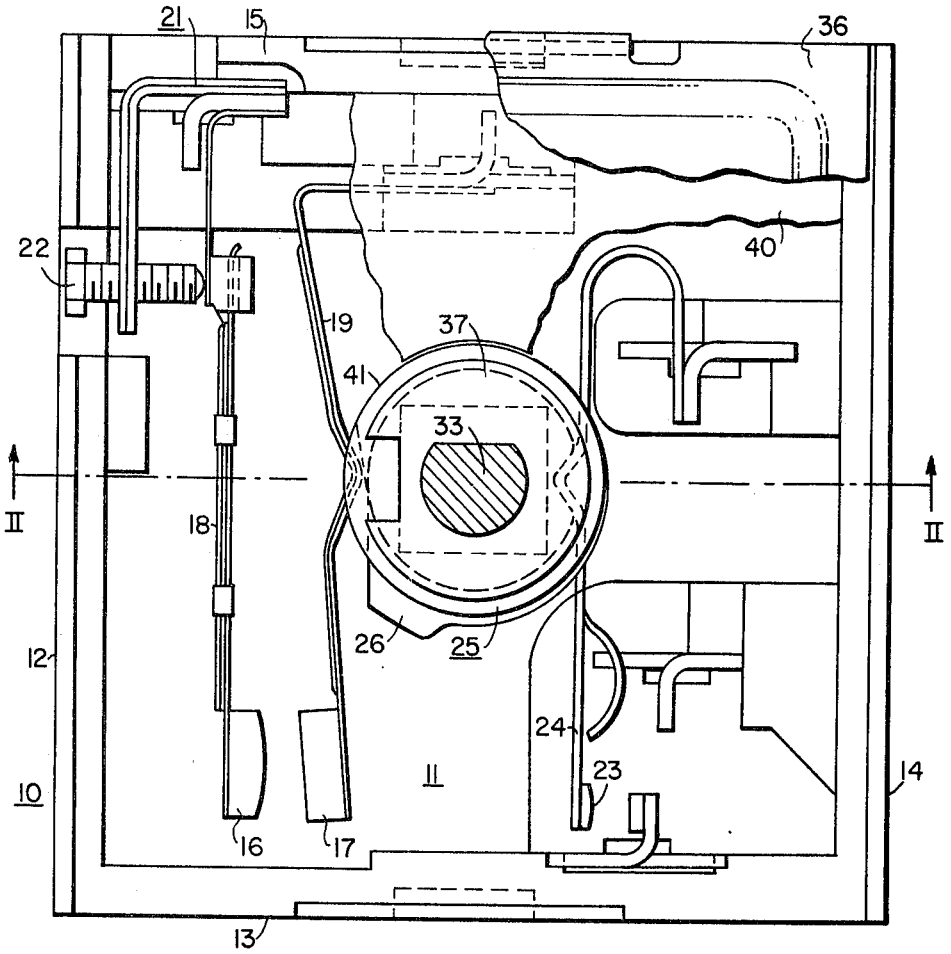
FIG. 1 is a front elevation of the thermal cycling switch incorporating the invention with the front cover removed.

The arrangement according to the invention is illustrated as being incorporated in basically the same type of thermal cycling switch as is disclosed in detail in U.S. Pat. No. 3,634,802, to which reference should be had for details as to construction and operation of those parts not of direct concern with this invention.

The thermal cycling switch includes an open-top, box-shaped casing 10 of square shape formed of rigid insulating plastic material and including a base wall 11 and four sidewalls 12–15. The main cycling switch portion of the switch assembly as a whole includes a cycling contact 16 facing an adjusted contact 17. The cycling contact is carried at the free end of a deflectable main bimetal assembly generally designated 18. The adjusted contact is carried on a cam adjusted spring arm 19.

An ambient compensating bimetal arrangement is indicated at 21 (FIG. 1), and an adjusting screw 22 is provided for initial calibration. A pilot light and a main line contact 23 is controlled by spring arm 24 on the opposite side of the centered cam arrangement 25 from the other spring arm 19.

Figure 2:
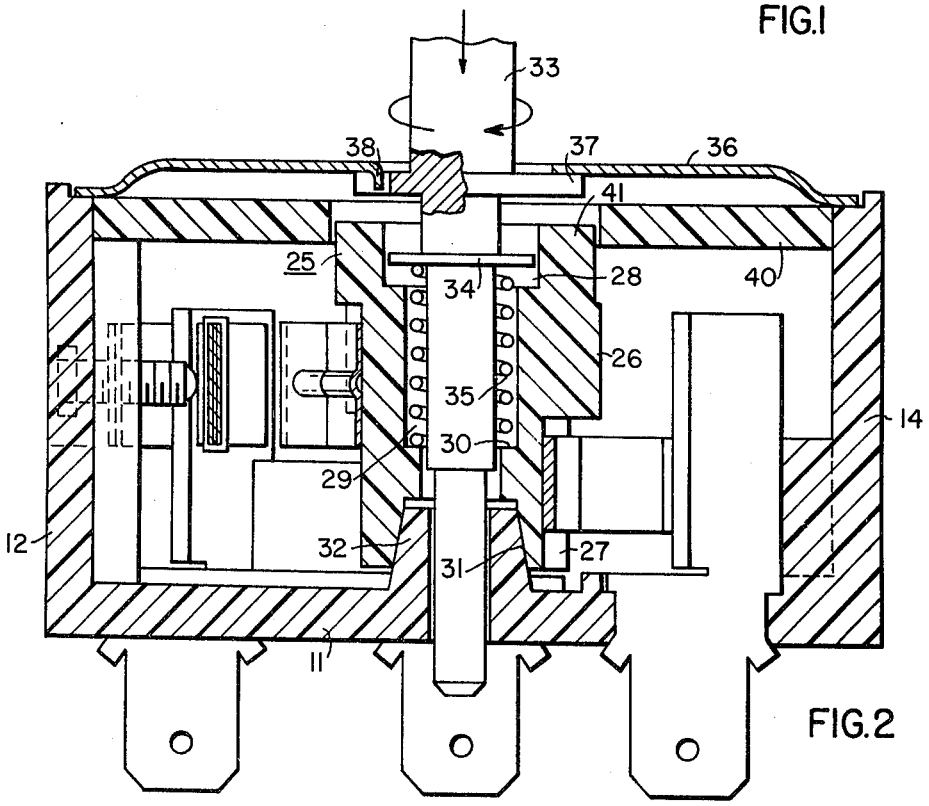
FIG. 2 is a sectional view corresponding to one taken along the line II—II of FIG. 1.

The cam 25 (FIG. 2) is hollow and has an upper circumferential cam face 26 for adjusting the one spring arm 19 and a lower cam face 27 for adjusting the other spring arm 24. The bore of the cam 25 is internally configured to include: an upper, square drive chamber 28; a central, circular, compression-spring chamber 29 bounded at the bottom by the annular shoulder 30; and a bottom end portion provided with a downwardly and outwardly tapering interior wall 31 which seats upon an exteriorly tapered collar 32 of the base 11. The shaft 33 of the switch is received within the cam bore and the tapered collar in axially shiftable relation therewith.

Figure 3:
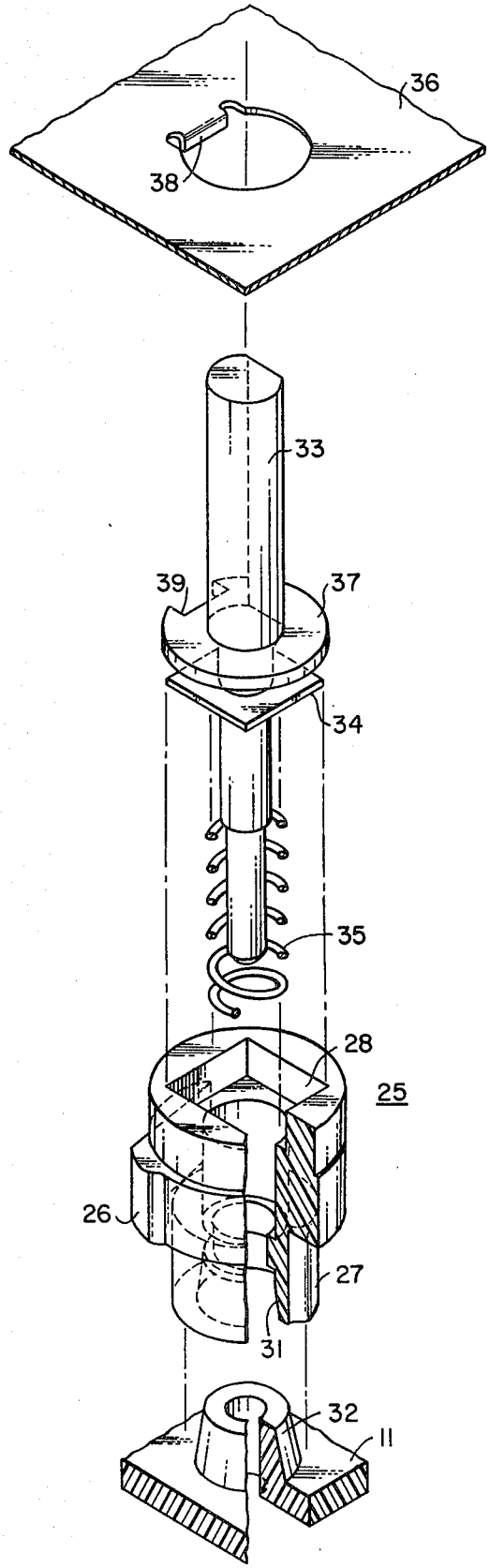
FIG. 3 is an exploded isometric view, broken in part, of the main parts of the invention.

The arrangement includes means at the upper end portion of the cam bore for fixing the shaft and cam for rotation together, such means comprising a drive plate (FIGS. 2 and 3) which is fixed to the shaft 33 and has a square exterior outline dimensioned to fit closely in the square drive chamber 28 but adapted to be movable up and down therewithin. A spring 35 in a compressed condition is located in the spring chamber 29 with its lower end bearing against the shoulder 30 and its upper end bearing against the lower side of the square drive plate 34.

In the currently preferred embodiment, the shaft 33 is prevented from being forced by the spring 35 up out of the cam by the switch cover 36 against which a washer 37, fixed to the shaft 33, bears. The cover and washer also serve to form the detent means which lock the shaft against rotation until it is shifted axially downwardly a predetermined. The detent means comprise a tab 38 in the cover 36 turned down to project below the lower face of the cover, and a notch 39 in the washer 37 located radially from the axis of the shaft the same distance as the location of the tab 38.

In the illustrated arrangement, the upper end of the cam is steadied against wobble by a plate 40 (FIGS. 1 and 2) having a central opening receiving the circular upper end portion 41 of the cam for rotation.

It will be appreciated that arrangements other than the specific one disclosed in the drawing may be used for holding the shaft from going beyond its upper position to which it is biased by the compression spring 35. One such arrangement would be, for example, a shaft projecting below the lower face of the base 11 of the casing and carrying a washer which would be separable from the shaft for assembly, but which is locked to the shaft for rotation therewith. The washer would have a radial projection on its circumference which would seat in a recess molded in the casing wall, the projection and recess serving as the detent means locking the shaft against rotation with the shaft in its upper position. Then when the shaft is shifted axially downwardly, the projection comes out of the recess and is adapted to ride on an annular surface. Such an arrangement may also include a stop at one end of the annular surface to ensure that the switch can be rotated only in a direction corresponding to increasing power inputs. The arrangement just described is currently considered to be less preferable than the arrangement illustrated in the drawing for several reasons. First, the illustrated arrangement provides a metal-to-metal contact and avoids the possibility of a metal tab shearing off a molded plastic stop. Secondly, the illustrated arrangement does not require a change in the tooling for the basic switch casing.

Some aspects of the invention may be better appreciated in view of the following. The compression spring 35 which urges the shaft to the upper position and at the same time urges the cam downwardly enhances the repeatability of a given setting of the switch. That is, the compression spring insures a firm seating of the lower end portion of the cam on the tapered collar 32 to avoid problems of lateral shifting of the lower end of the cam. The force of the seating is emphasized when the switch is turned on by shifting the shaft axially downwardly since the spring is further compressed in this condition.

The use of the relatively large drive plate 34 reduces the chance of angular slop between the shaft and the cam. In this connection it is noted that non-circular outlines other than a square could be used for the drive plate and recess. The square arrangement is preferred in that it gives four angles of reference to accommodate different models of cook tops having different locations of indexing. While a triangular drive plate, or simply a cross bar could be used as a drive plate, with a complementary shaped recess in the cam in these cases only three and two angles of reference would be available.

I claim:

1. In a thermal cycling switch including a casing with a base wall having an exteriorly tapered collar with a central bore, a cover opposite the base wall, a bimetal assembly carrying one switch contact and a spring arm carrying an opposite switch contact movable toward and away from the bimetal assembly, a switch controlling arrangement comprising:

a rotatable shaft having its lower end journaled in said base wall and its upper end projecting out of said cover;

a hollow cam having circumferential cam faces thereon for adjusting said spring arm, said cam having a bore receiving said shaft therethrough in axially shiftable relation;

means at the upper end of said bore fixing said shaft and cam for rotation together;

compression spring means in said bore urging said shaft toward an upper position and said cam downwardly to seat its lower end portion on said tapered collar; and detent means locking said shaft against rotation when said shaft is in said upper position and permitting said rotation upon shifting said shaft axially downwardly a predetermined amount.

2. In a switch according to claim 1 wherein:

said means fixing said shaft and cam together for rotation comprise a member of non-circular outline fixed to said shaft, and a recess in said cam having a shape in outline complementary to said member for receiving said member.

3. In a switch according to claim 2 wherein:

said member has a square outline to accommodate indexing of said shaft to said cam at four equiangularly displaced positions.

4. In a switch according to claim 1 wherein;

said lower end portion of said cam includes a tapered portion complementary in angular shape to said tapered collar.

5. In a switch according to claim 1 including:

a washer carried by said shaft adjacent said cover: and said detent means comprises a tab in either said washer or said cover and a cooperating slot in the other.

6. In a thermal cycling switch having a casing with a base wall, a cover for the opposite side of the casing, a bimetal assembly carrying a switch contact, and a cam adjusted spring arm carrying another switch contact, a push-to-turn arrangement comprising:

a rotatable shaft having its lower end journaled in said base wall;

an inwardly-directed, exteriorly-tapered, hollow collar at said base wall to receive in its bore a lower end portion of said rotatable shaft;

a rotatable hollow cam having exterior cam face means for positioning said spring arm relative to said bimetal assembly, said cam having a central bore for receiving said shaft therethrough in axially shiftable relation, said bore including a lower part having an interior taper received on said collar, a central part forming a spring chamber encircling said shaft, and an upper part including means for engaging said shaft in non-rotatable relation;

a compression spring in said spring chamber biasing said shaft toward an upper position and said cam downwardly;

means to retain said shaft against upward movement beyond said upper biased position of said shaft; and means including a detent at an off angular position of said shaft to prevent its rotation when said shaft is in said upper biased position so that said shaft must be pushed downwardly before being rotated.

* * * * *